United States Patent [19]

Kuchenbecker

[11] 4,096,948

[45] Jun. 27, 1978

[54] COOK-IN CARTON WITH INTEGRAL REMOVABLE SECTION AND BLANK THEREFOR

[75] Inventor: Morris W. Kuchenbecker, Neenah, Wis.

[73] Assignee: American Can Company, Greenwich, Conn.

[21] Appl. No.: 779,807

[22] Filed: Mar. 18, 1977

[51] Int. Cl.[2] ..... B65D 5/70

[52] U.S. Cl. ..... 206/622; 206/0.5; 426/113; 426/122; 206/491; 222/541

[58] Field of Search ..... 426/113, 114, 122; 229/22; 206/0.5, 491.1; 222/541, 565; 239/60

[56] References Cited

U.S. PATENT DOCUMENTS

| | | | |
|---|---|---|---|
| 2,449,513 | 9/1948 | Schmidt | 206/0.5 |
| 2,777,769 | 1/1957 | Hodges | 426/113 |
| 3,623,650 | 11/1971 | Watts | 229/22 X |
| 3,876,131 | 4/1975 | Tolaas | 229/22 |

*Primary Examiner*—Davis T. Moorhead

*Attorney, Agent, or Firm*—Robert P. Auber; Ernest L. Brown; Ira S. Dorman

[57] ABSTRACT

A carton, adapted for use in heating a product, is provided with openings to permit gas and heat flow. An integrally formed section of an outer panel of the carton serves to cover the openings, and is readily removed prior to use of the carton. As an additional feature, the panel in which the removable section is formed may also provide elements which can be positioned to function as legs to elevate the carton above a supporting surface.

8 Claims, 3 Drawing Figures

COOK-IN CARTON WITH INTEGRAL REMOVABLE SECTION AND BLANK THEREFOR

BACKGROUND OF THE INVENTION

It is well known that it is advantageous to provide openings in containers in which products are heated, so as to facilitate the flow of heat and gases to and from the product. This is particularly true in the case of cartons designed for the packaging of frozen goods which are to be prepared by microwave cooking, since adequate exposure of the product is necessary for satisfactory thawing, browning of crusts, and the like. An exemplary carton is described and claimed in Tolass U.S. Pat. No. 3,876,131.

The carton of that patent is adapted specifically for the containment and heating of a wedge-shaped piece of pizza, and is provided with a series of apertures, which are normally closed by a removable film overlay. While the Tolass carton may function desirably for its intended purpose, the need to secure the overlay film thereto is undesirable from a manufacturing standpoint. Not only does its application require a separate operation, but it also introduces into the manufacturing procedure the necessity for handling a material unlike that from which the carton per se is fabricated, and the use of a film may require the provision of special means to enable facile removal.

Elevation of such a carton above the support surface is also beneficial during heating, again to promote ventilation. While the Tolass carton has structure providing that feature, the elevating elements thereof extend beneath the body of the carton in its normal, as erected, configuration, thus unduly increasing the volume occupied by the carton (such as during transport) and subjecting those elements to possible damage and distortion.

Accordingly, it is an object of the present invention to provide a novel carton which enables the efficient heating of a product contained therewithin.

It is a more specific object of the invention to provide such a carton having openings for the passage of heat and gases, which openings are normally closed by a panel section which is readily removed and is integrally formed of the material from which the carton is constructed.

Another object of the invention is to provide a carton of the foregoing type which is readily set up and filled, and is pleasing from an aesthetic standpoint.

Still another object of the invention is to provide a carton having the foregoing features and advantages and, in addition, including integral and compact means for elevating the carton above a support surface during heating.

A further object is to provide a novel blank from which the foregoing carton may be constructed.

SUMMARY OF THE DISCLOSURE

It has now been found that the foregoing and related objects of the invention are readily attained in a carton comprised of a plurality of hingedly interconnected panels, two of which are similarly dimensioned and configured and are secured in face-to-face contact, to provide a two-ply wall in the carton. A portion of the inner of those two panels has openings formed therein, to permit substantial exposure of the contained product. The outer of the two panels has a weakened area defining therein a removable section, which is dimensioned and configured to cover the open portion of the inner panel. The removable section of the outer panel overlies the open portion of the inner panel, to close the openings thereof, with its disengagement effecting substantial exposure of the contained product.

In preferred embodiments, the weakened area of the outer panel extends to opposite margins thereof, and a rectilinear fold line extends between the opposite margins at a location spaced to each side of the weakened area, so as to define foldable tab portions therebetween. The portions of the outer panel which lie outwardly of the tab portions are secured to the inner panel so that, upon removal of the removable section of the outer panel, the tab portions may be folded about the fold lines away from the inner panel, to thereby provide support legs on the carton.

Preferably, the weakened area of the outer panel will be comprised of two spaced lines of weakness extending thereacross. Generally the outer panel will be of generally rectangular configuration; the lines of weakness will be rectilinear, and they, as well as the fold lines, will be perpendicular to the opposite margins of the panel, and symmetrically disposed thereon.

Certain objects of the invention are attained in a blank comprised of a plurality of hingedly interconnected panels. A first panel adjacent one end of the blank has a portion with openings formed therein, to permit substantial exposure of the product contained within the carton. A second panel adjacent the other end of the blank is dimensioned and configured similarly to the first panel, and has a weakened area defining therein a removable section, which is dimensioned and configured to cover the open portion of the first panel. The blank is foldable into a carton configuration, with the first and second panels in face-to-face contact to provide a two-ply wall, wherein the removable section of the second panel overlies the open portion of the first panel, to close the openings thereof. In especially preferred embodiments, the blank is fabricated from a material consisting essentially of paperboard and other non-conductive material which is particularly adapted for microwave cooking.

DETAILED DESCRIPTION OF THE ILLUSTRATED EMBODIMENTS

Figure 1:
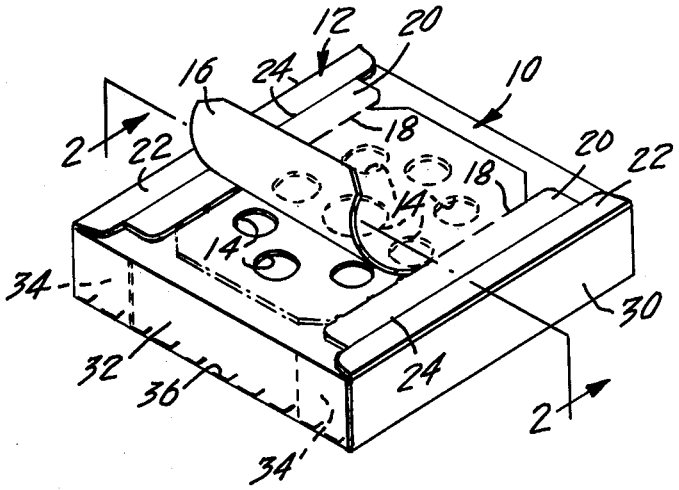
FIG. 1 is a perspective view of a carton embodying the present invention, with the removable section of the outer panel partially disengaged, the fully engaged condition of that part being shown in phantom line.
Figure 2:
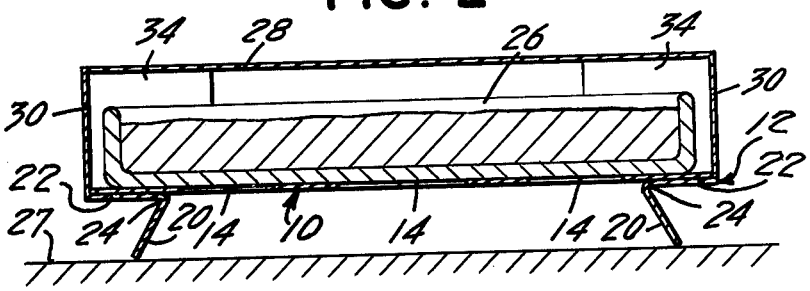
FIG. 2 is a sectional view, to an enlarged scale, along line 2—2 of FIG. 1, showing the removable section fully disengaged, with elements of the outer panel deformed to provide supporting legs and with the carton inverted and seated upon a support surface.

Turning now in detail to the appended drawing, FIGS. 1 and 2 thereof illustrate a carton embodying the present invention. The carton is fabricated from the blank of FIG. 3, and consists of a plurality of hingedly interconnected panels, which will hereinafter be described in detail with particular reference to the latter Figure. The essence of the invention, however, resides in the bottom panels generally designated by the numerals 10 and 12, which will therefore be described initially.

The panel 10 is typical, except for the fact that it is provided with a pattern of openings 14; it is disposed in underlying relationship to the panel 12, and is the innermost of the two, which together provide a two-ply bottom wall of the carton. Panel 12 consists of a rectangular removable section 16, which is defined therein by parallel lines of perforation 18 running from side to side thereacross. Elongated tabs 20 lie, in mirror image fashion, to opposite sides of the section 16, and a glue flap 22 lies outwardly of each of the tabs 20. The endmost glue flap 22 is joined to the adjacent tab 20 by a fold or hinge line 24; the opposite flap 22 is similarly joined, not only to the adjacent tab 20 but also to the remainder of the blank.

As seen in FIG. 1, the removable section 16 is simply torn away along the perforated lines 18, to expose the openings 14 of the panel 10, and thereby to afford substantial exposure of the product 26 contained within the carton. Upon removal of the section 16, the tabs 20 may be bent from their flat position against the panel 10 to an angle of 90° or less, relative to the corresponding tabs 22. In that condition they may, as seen in FIG. 2, serve as legs to support the carton in an elevated position above the supporting surface 27, so as to further promote the desired ventilation of the contents of the carton.

Figure 3:
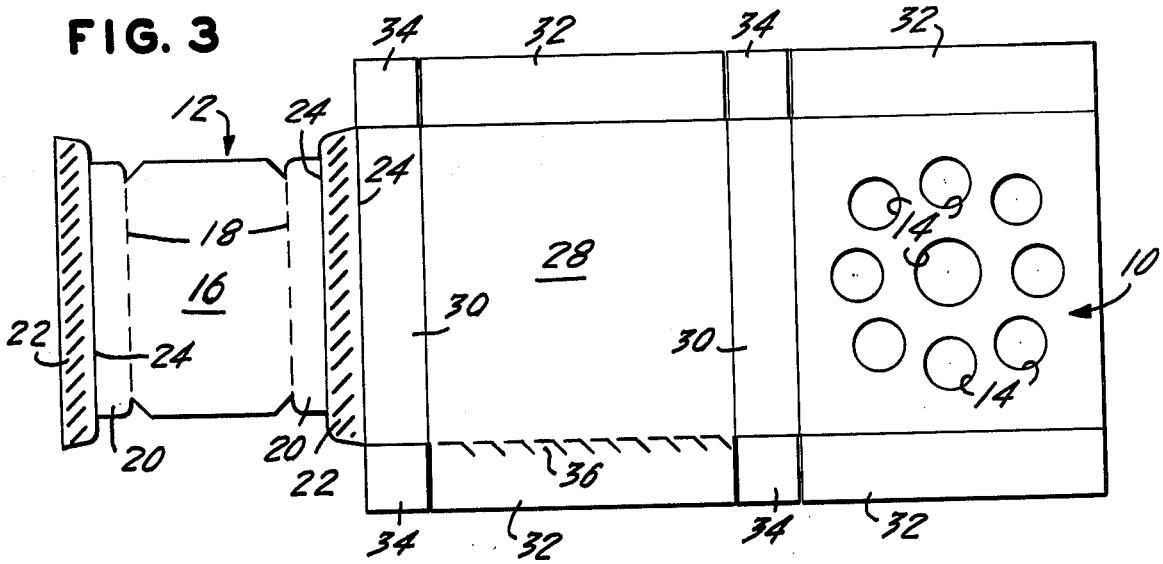
FIG. 3 is a plan view of the blank from which the carton of FIG. 1 is constructed, drawn to a scale slightly diminished therefrom.

Finally, with particular reference to FIG. 3, the blank illustrated includes a top panel 28 hingedly joined to the panels 10 and 12 through side panels 30. Also included in the blank are appropriate hingedly connected end flaps 32 and closing tabs 34. As will be understood, the entire blank is formed from a single piece of suitable material.

In setting up the carton, it will readily be appreciated that the glue flaps 22 are adhesively bonded to the outer surface of the panel 10, and that the tabs 34 are similarly secured to the end flaps 32, in conventional fashion. It will also be noted that one of the end flaps 32 is joined to the top panel 28 by a weakened hinge line 36, whereby opening of the carton to obtain access to the contained product 26 is facilitated.

The container will, of course, normally be fabricated from paperboard, on or to which films and coatings of synthetic resinous materials or natural organic substances may be applied. While metal foil laminates may be employed for some applications, they would be inappropriate where the carton is to be used for microwave cooking.

Thus, it can be seen that the present invention provides a novel carton which enables the efficient heating of a product contained therewithin. The carton has openings for the passage of heat and gases, which openings are normally closed by a panel section which is readily removed and is integrally formed of the material from which the carton is constructed. It is readily set up and filled, and is pleasing from an aesthetic standpoint. The invention also provides a carton including integral and compact means for elevating it above a support surface during heating, and it furthermore provides a novel blank from which a carton having the foregoing desired features and advantages may readily be constructed.

Having thus described the invention, what is claimed is:

1. A carton adapted for use in heating a product contained therewithin, comprising a plurality of hingedly interconnected panels, two of said panels being similarly dimensioned and configured and being secured in face-to-face contact to provide a two-ply wall in said carton, a portion of the inner of said two panels having openings formed therein to permit substantial exposure of the contained product, the outer of said two panels having a weakened area extending to opposite margins thereof defining therein a removable section dimensioned and configured to cover said open portion of said inner panel, said removable section overlying said inner panel to close said openings thereof, a rectilinear fold line extending between said opposite margins of said outer panel at a location spaced to each side of said weakened area to define foldable tab portions therebetween, the portions of said outer panel lying outwardly of said tab portions being secured to said inner panel so that, upon removal of said removable section of said outer panel, said tab portions may be folded about said fold lines away from said inner panel, to thereby provide support legs on said carton, and disengagement of said removable section from the remainder of said outer panel uncovering said openings and effecting substantial exposure of the product contained within said carton.

2. The carton of claim 1 wherein said weakened area is comprised of two spaced lines of weakness extending across said outer panel.

3. The carton of claim 2 wherein said outer panel is of generally rectangular configuration, wherein said lines of weakness are rectilinear, and wherein said lines of weakness and said fold lines are perpendicular to said opposite margins of said outer panel and symmetrically disposed thereon.

4. A carton fabricated of a material consisting essentially of paperboard and adapted for microwave cooking, comprising a plurality of hingedly interconnected panels, two of said panels being similarly dimensioned and configured and being secured in face-to-face contact to provide a two-ply wall in said carton, a portion of the inner of said two panels having openings formed therein to permit substantial exposure of the contained product, the outer of said two panels having a weakened area defining therein a removable section dimensioned and configured to cover said open portion of said inner panel, said removable section overlying said open portion of said inner panel to close said openings thereof, with disengagement of said section from the remainder of said outer panel uncovering said openings and thereby effecting substantial exposure of the product contained within said carton.

5. A blank for producing a carton adapted for use in heating a product contained therewithin, comprising a plurality of hingedly interconnected panels, a first panel adjacent one end of said blank having a portion with openings formed therein to permit substantial exposure of the product contained within the carton, and a second panel adjacent the other end of said blank, dimensioned and configured similarly to said first panel and having a weakened area extending to opposite margins of said blank and defining therein a removable section which is dimensioned and configured to cover said open portion of said first panel, said blank being foldable into a carton configuration with said first and second panels in face-to-face contact to provide a two-ply wall wherein said removable section of said second panel overlies said open portion of said first panel to close said openings thereof, and a rectilinear fold line extends between said opposite margins at a location within said second panel spaced to each side of said weakened area, to define foldable tab portions therebetween adapted to be folded so as to provide support legs on the carton.

6. The blank of claim 5 wherein said weakened area is comprised of two spaced lines of weakness extending across said blank.

7. The blank of claim 6 wherein said first and second panels are of generally rectangular configuration, wherein said lines of weakness are rectilinear, and wherein said lines of weakness and said fold lines are perpendicular to said margins of said blank and symmetrically disposed on said second panel.

8. A blank fabricated of a material consisting essentially of paperboard for producing a carton adapted for microwave cooking, comprising a plurality of hingedly interconnected panels, a first panel adjacent one end of said blank having a portion with openings formed therein to permit substantial exposure of the product contained within the carton, and a second panel adjacent the other end of said blank, dimensioned and configured similarly to said first panel and having a weakened area defining therein a removable section which is dimensioned and configured to cover said open portion of said first panel, said blank being foldable into a carton configuration with said first and second panels in face-to-face contact to provide a two-ply wall wherein said removable section of said second panel overlies said open portion of said first panel to close said openings thereof.

* * * * *